United States Patent [19]

Simeth

[11] Patent Number: 4,721,041

[45] Date of Patent: Jan. 26, 1988

[54] DEVICE FOR A SERIES-PRODUCED SHEET-FED OFFSET ROTARY PRESS

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 910,491

[22] Filed: Sep. 23, 1986

[30] Foreign Application Priority Data

Oct. 5, 1985 [DE] Fed. Rep. of Germany ..... 3535694

[51] Int. Cl.[4] ..... B41F 21/10; B41F 5/22

[52] U.S. Cl. ..... 101/230

[58] Field of Search ..... 101/229, 230, 231, 183, 101/184, 185, 136, 137, 142; 271/184, 185, 186, 69, 277, 225

[56] References Cited

U.S. PATENT DOCUMENTS 3,884,146 5/1975 Ruetschle ..... 101/230 X 4,378,734 4/1983 Wirz ..... 101/230

*Primary Examiner*—J. Reed Fisher

*Attorney, Agent, or Firm*—Leydig, Voit & Mayer

[57] ABSTRACT

A series-produced sheet-fed offset rotary press having drum transfer systems in which sheet conveyance is carried out entirely through mechanical gripper transfers from a first impression cylinder to a transfer cylinder, then successively to a double-size transfer drum, then to a turning cylinder and then to a second impression cylinder and which are selectively engageable for multi-color printing on one side or alternately for perfecting printing and wherein, to change over sheet movement between these two operational modes the double-size transfer drum is selectively movable into one of two positions and is variable in its direction of rotation, the double-size transfer drum being engageable, in the first position and first direction of rotation and with the transfer cylinder disengaged, with two double-size impression cylinders for one-sided multicolor printing; while, in a second position and in the second direction of rotation, for perfecting, the double-size transfer drum can be lowered into engagement with the turning cylinder and the previously disengaged transfer cylinder can be lowered into engagement with the first double-size impression cylinder and with the double-size transfer drum; and wherein the distance between the impression cylinders is less than the diameter of the double-size transfer drum.

4 Claims, 2 Drawing Figures

DEVICE FOR A SERIES-PRODUCED SHEET-FED OFFSET ROTARY PRESS

FIELD OF THE INVENTION

The present invention relates generally to a series-produced sheet-fed offset rotary press and more particularly to a drum transfer system for multi-color printing on one side and for perfecting whereby the double-size transfer drum is movable at choice into one of two positions and is variable in its direction of rotation.

BACKGROUND OF THE INVENTION

A similar press is disclosed in DE-PS No. 1 107 246. When this press is set up for perfecting, grippers on the turning cylinder periphery and operative in perfecting, engage the trailing edge of the sheet and disengage it from the previous double-size transfer cylinder. Thereafter the grippers pivot inwards around their own axis until they engage an inner abutment element. Grippers for two-color printing, present on the turning cylinder periphery, also pivot inwards around their own axis until they abut another inner abutment element. The trailing edge of the sheet is then transferred from the pivoted-in perfecting grippers to the two-color grippers turning the sheet and maintaining registration so that the trailing edge of the sheet is now the leading edge. The entirely mechanical gripper transfers of this known press ensure that the engagement, transfer and delivery of each sheet is always exactly uniform, thus ensuring the necessary maintenance of registration.

The known machine also has suction devices on the turning cylinder periphery located behind the grippers relative to the direction of rotation of the turning cylinder. These suction devices provide additional retention of the trailing sheet edge. The disadvantage of this patented press is that the sheet moves jerkily and creates registration problems in multi-color printing on one side when operating at increased speeds. Another disadvantage arises when the press is required to print rigid substrates such as paper board or card stock. Also, the considerable curvature of the sheet on the single-size transfer cylinders, the many changes of curvature, and of the large number of gripper transfers hamper the printing process when applying multiple colors. The greatest speeds at which multi-color printing can be carried out using this press are merely the lowest speeds of conventional perfecting.

Another patent, DE-AS No. 2 350 132, teaches a series-produced rotary press in which the sheets are conveyed entirely by means of mechanical gripper transfers from a first double-size impression cylinder. The sheets run smoothly in multi-color printing on one side in this press. However, the disadvantage arises in perfecting where blowing and suction boxes are additionally needed in the transfer zone of the double-size transfer drum to obviate set-off of the sheet on the drum, more particularly, set-off of the sheet end after turning.

OBJECTS AND SUMMARY OF THE INVENTION

The primary aim of the present invention is to provide a sheet-fed offset rotary press in which sheet movement, which proceeds in perfecting by way of two transfer cylinders and the double-size transfer drum, can proceed in multi-color printing on one side merely by way of the double-size transfer drum as the single drum between two double-size impression cylinders, with a reduction of the dimensions between consecutive printing units to ensure a compact series construction.

This device combines a number of advantages of sheet turning by means of an arrangement comprising a first transfer cylinder, a double-size transfer drum and a turning cylinder between two impression cylinders. The advantages of three-drum turning, particularly smear-free sheet movement and maintaining registration in sheet turning are enhanced by mechanical gripper transfers, and by the additional possibility of changing over the double-size transfer drum. Also, the known advantages of a smooth and gentle sheet movement using only a single double-size transfer drum between double-size impression cylinders—i.e., normal between-drums movement—for multi-color printing on one side is maintained by this new invention. Multi-color printing on one side in sheet-fed offset rotary presses of this kind hereinbefore set out is then free from the disadvantageous limitations of presently used three-drum turning. More particularly, multi-color printing on one side in sheet-fed offset rotary presses is free from the limitations and difficulties in dealing with heavy paper board at press speeds higher than 10,000 sheets/hr. Also, the selectable sheet movement of this invention produces a series construction with a reduction of the dimensions between consecutive printing units since in perfecting the consecutive three drums or transfer cylinders are more compactly joined together than in the conventional arrangement.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
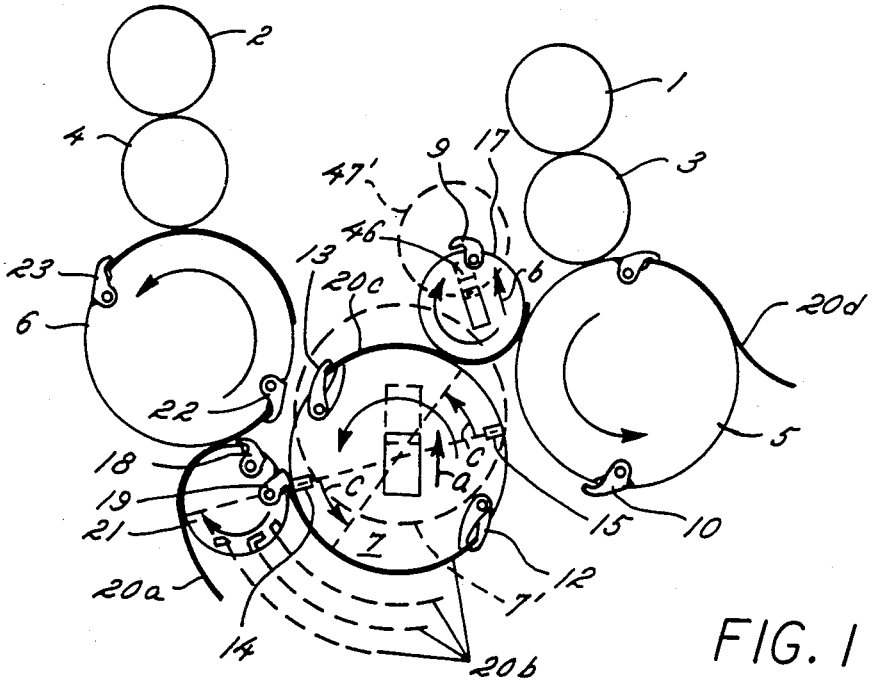
FIG. 1 is a diagrammatic cross-section of a sheet-fed offset rotary press having two printing units arranged in series in the position for perfecting.
Figure 2:
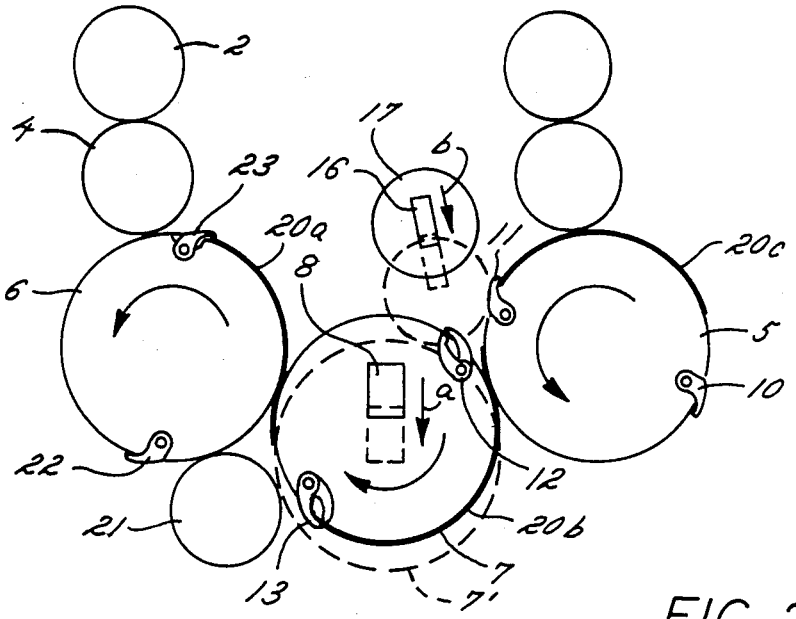
FIG. 2 is a similar diagrammatic cross-section of a sheet-fed rotary press set up for multi-color printing on one side, the press having two printing units arranged in series.

A two-color printing unit shown diagrammatically in cross-section in FIGS. 1 and 2 comprises two plate cylinders 1, 2, two blanket cylinders 3, 4 and two double-size impression cylinders 5, 6 between which a transfer cylinder 17, a double-size transfer drum 7 and a turning drum 21 are disposed. Sheet transfer is generally by mechanical gripper transfers. To this end, gripper rows 10, 11 are provided on the impression cylinder 5, gripper rows 9 on the transfer cylinder 17 and gripper rows 12, 13 on the double-size transfer drum 7, Cooperating gripper rows 18, 19, which are adapted to pivot inwardly, are provided in known manner on the turning drum 21 and gripper rows 22, 23 are provided on the impression cylinder 6. The inking mechanisms associated with the plate cylinders 1, 2 are not shown.

Pursuant to the present invention, the double-size transfer drum 7 is variable in its direction of rotation and, like the transfer cylinder 17, is disposed in movable bearings 8, 16 respectively. The drum 7 and cylinder 17 move into positions 7' and 17' respectively as indicated by arrows a and b in FIGS. 1 and 2. It will be understood that the gripper rows 12, 13 on the drum 7 have gripping tongs. In accordance with the invention, the drum 7 can be moved selectively into one of two positions and have its direction of rotation varied for sheet movement adapted to be changed over between perfecting (FIG. 1) and multi-color printing on one side (FIG. 2). In the position shown in FIG. 2, the transfer cylinder 17 is disengaged and there is contact by the double-size transfer drum 7 with the two double-size impression cylinders 5, 6 for multi-color printing on one side. Alternatively, in the FIG. 1 position and second direction of rotation for perfecting, the double-size transfer drum 7 can be moved down into engagement with the turning cylinder 21 and the previously disengaged transfer cylinder 17 can be engaged downwardly with the first double-size impression cylinder 5 and the double-size transfer drum 7.

To ensure that the rear edge of the sheet 20 engages satisfactorily with the double-size drum 7 and to ensure a transfer with accurate registration, smoothing means 14, 15 adjustable towards the sheet end are provided, as indicated by arrows c in FIG. 2. Alternatively, the smoothing means 14, 15 can be omitted and additionally, in known manner, suction means can be provided on the turning cylinder periphery and blowing or suction means can be provided to apply the sheet to the double-size transfer drum 7 in order to retain the trailing edge of the sheet and to make certain that the sheet moves without set-off.

From the foregoing, it will be appreciated that sheet movement and sheet transfer in multi-color printing on one side are carried out with just a single double-size transfer drum 7 between double-size impression cylinders 5, 6 and in perfecting by means of a transfer cylinder 17, a double-size transfer drum 7 and the turning drum 21 between the double-size impression cylinders 5, 6, in each case in known manner so that further explanation is unnecessary. All that has to be done is carry out the appropriate changeovers.

The movement of the drum 7 and cylinder 17 is not limited to the moveable bearings 8, 16 referred to and other known devices for varying the geometric position and the direction of rotation of a drive shaft can be used to change over sheet movement.

I claim as my invention:

1. A sheet-fed offset rotary press having spaced first and second impression cylinders, each having a respective cooperating blanket cylinder, said first and second impression cylinders each having sheet grippers;

a sheet transfer system between said first and second impression cylinders including, in succession, a transfer cylinder having sheet grippers, a transfer drum having sheet grippers, and a turning drum having sheet grippers for grasping a trailing sheet end, said turning drum being rotatably engaged with said second impression cylinder;

said impression cylinders and transfer drum each having a diameter twice the size of said blanket cylinders, the distance between said impression cylinders being less than the diameter of said transfer drum; means for displacing said transfer cylinder out of engagement with said first impression cylinder, means for displacing said transfer drum out of engagement with said turning drum and into raised engagement with said first and second impression cylinders, and means for selectively rotating said transfer drum in first and second rotational directions;

whereby the sheet transfer system functions for selective sheet movement between two operational modes, a first mode for multi-color printing on one side of the sheet, and a second mode for perfecting printing;

wherein in the first mode the transfer drum is rotated in a first rotative direction and raised into engagement with each of said impression cylinders with the transfer cylinder being displaced from each said first impression cylinder and said transfer drum for performing one-sided multi-color printing; and in the second mode, the transfer drum is lowered into engagement with the turning drum, the transfer cylinder is lowered into engagement with said first impression cylinder and said transfer drum for performing perfecting printing.

2. A sheet-fed offset rotary press according to claim 1, wherein said transfer cylidner and said double-size transfer drum are disposed in movable bearings.

3. A sheet-fed offset rotary press according to claim 1, wherein said grippers on said double-sized transfer drum have gripper tongs and, in said perfecting mode, smoothing means adjustable towards said trailing sheet end are disposed after the tongs as viewed in the direction of rotation.

4. A sheet-fed offset rotary press according to claim 2, wherein said grippers on said double-size transfer drum have gripper tongs and, in said perfecting mode, smoothing means adjustable towards said trailing sheet end are disposed after the tongs as viewed in the direction of rotation.

* * * * *